US009375043B1

(12) United States Patent
Fountain

(10) Patent No.: US 9,375,043 B1
(45) Date of Patent: Jun. 28, 2016

(54) TREADED BRIM HAT

(71) Applicant: Steven Sadamu Fountain, Kekaha, HI (US)

(72) Inventor: Steven Sadamu Fountain, Kekaha, HI (US)

( * ) Notice: Subject to any disclaimer, the term of this patent is extended or adjusted under 35 U.S.C. 154(b) by 36 days.

(21) Appl. No.: 14/619,970

(22) Filed: Feb. 11, 2015

(51) Int. Cl.
*A42B 1/00* (2006.01)
*A42B 1/06* (2006.01)
*A42C 99/00* (2006.01)

(52) U.S. Cl.
CPC ..... *A42B 1/062* (2013.01); *A42C 99/00* (2013.01); *A42B 1/004* (2013.01)

(58) Field of Classification Search
CPC ..... A42B 1/004; A42C 1/06; A42C 99/00
USPC ..... 2/200.2
See application file for complete search history.

(56) References Cited

U.S. PATENT DOCUMENTS

| | | | | |
|---|---|---|---|---|
| D497,342 | S * | 10/2004 | Alves et al. | D12/417 |
| D506,615 | S * | 6/2005 | Alves et al. | D3/322 |
| 6,964,064 | B1 * | 11/2005 | Yan | 2/175.2 |
| 2005/0010991 | A1 * | 1/2005 | Sterling et al. | 2/171 |
| 2006/0174398 | A1 * | 8/2006 | Proctor | 2/209.13 |
| 2006/0185061 | A1 * | 8/2006 | Wakefield | A42B 1/004 2/195.1 |
| 2009/0094731 | A1 * | 4/2009 | Bender | 2/244 |
| 2009/0205109 | A1 * | 8/2009 | Butler | 2/195.1 |

* cited by examiner

*Primary Examiner* — Andrew W Collins
*Assistant Examiner* — Brieanna Szafran
(74) *Attorney, Agent, or Firm* — Plager Schack LLP

(57) ABSTRACT

The present invention relates to a headwear grip system configured to substantially increase friction to a user's hand while gripping the headwear and increased friction to a surface the headwear may rest on. The system has a headwear configured to rest on a wearer's head, a grip surface that has an upper grip surface and a lower grip surface where the upper grip surface attaches to the headwear.

4 Claims, 1 Drawing Sheet

TREADED BRIM HAT

BACKGROUND

The embodiments herein relate generally to hats. More specifically, embodiments of the invention are directed to head-wear that allows the user to more easily grip the brim of the hat or headwear and place the hat or headwear down on angled surfaces without the concern of hat or head-wear sliding off of the surface.

Headwear is a commonly used item by the population. The use of headwear have a wide range of function including protection from the harmful radiation of the sun to fashion. They can also be mandatory requirements for certain professions such as those pertaining to construction sites and sports. Headwear can be made of varying materials and have multiple designs that work as function, form, or fashion.

Conventional headwear, however, fail to provide the user a surface for optimal holding or gripping of the headwear. Headwear may become wet and slippery due to sweat or the particular environment the user may be using the headwear in, such as in or on a body of water. The lack of an additional gripping surface can also result in the headwear to slide if placed on an uneven surface. As a result, there is a need for a graspable surface on a headwear that provides added friction to the users hand and surfaces the headwear may be placed on.

SUMMARY

The present invention relates to a headwear grip system configured to substantially increase friction to a user's hand while gripping the headwear and increased friction to a surface the headwear may rest on. The system has a headwear configured to rest on a wearer's head. The system also has a grip surface configured to have an upper grip surface and a lower grip surface wherein the upper grip surface attaches to the headwear.

BRIEF DESCRIPTION OF THE FIGURES

The detailed description of some embodiments of the invention will be made below with reference to the accompanying figures, wherein like numerals represent corresponding parts of the figures.

DETAILED DESCRIPTION OF CERTAIN EMBODIMENTS

Figure 1:
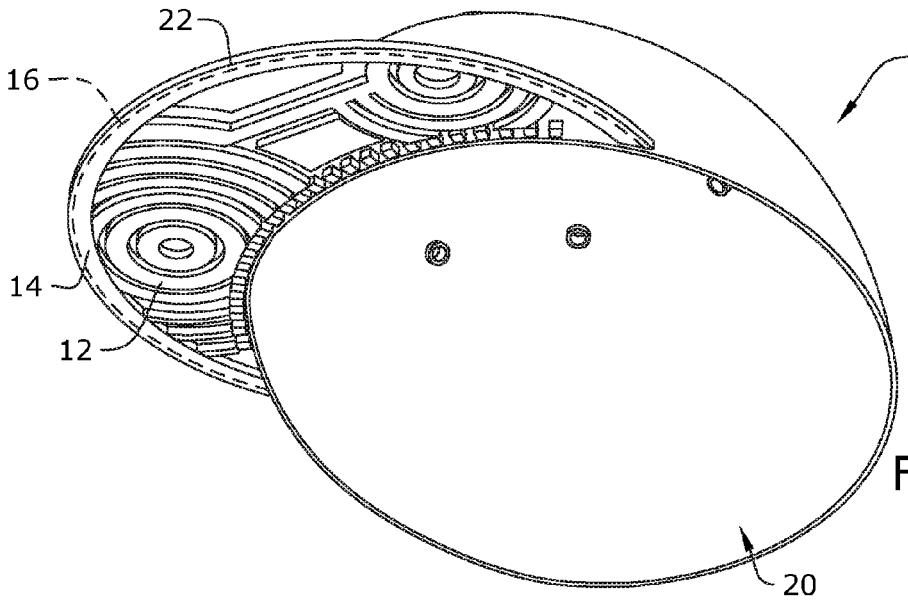
FIG. 1 shows a bottom perspective view of one embodiment of the invention.
Figure 2:
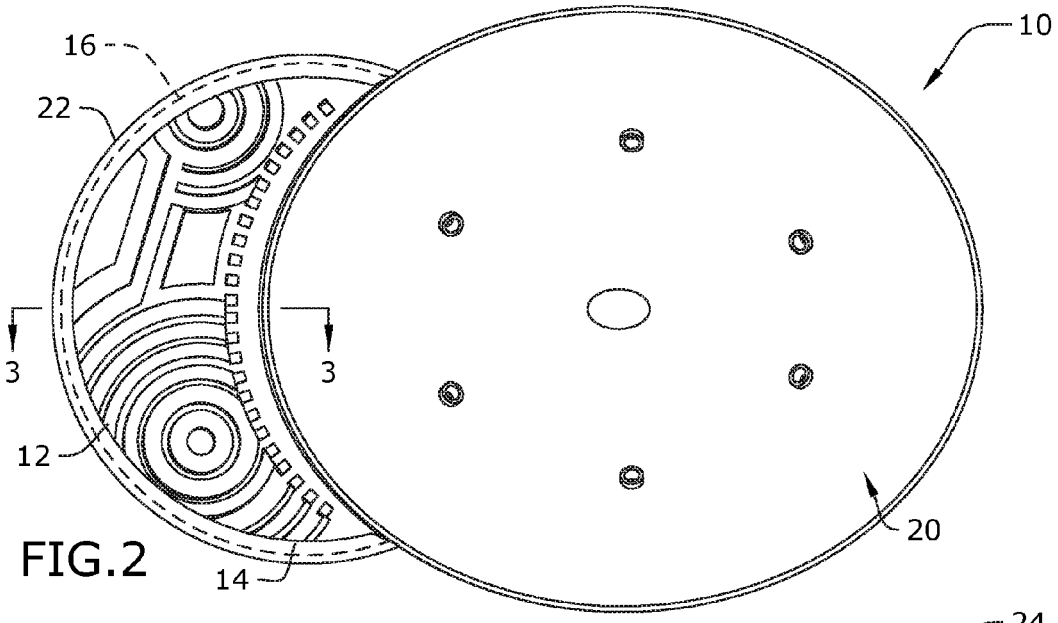
FIG. 2 shows a bottom view of one embodiment of the invention.
Figure 3:
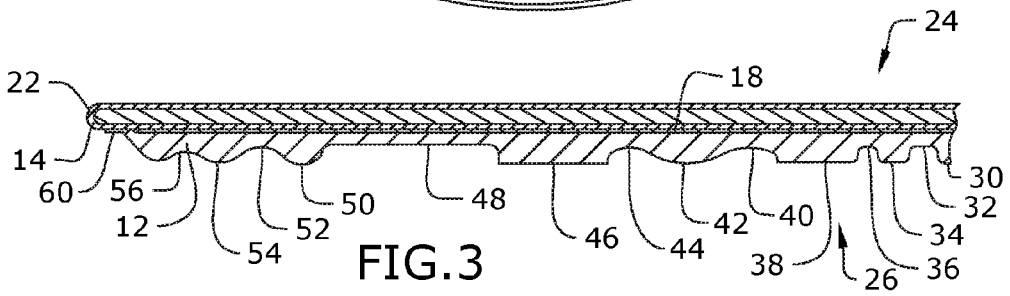
FIG. 3 shows a section view of the invention along line 3-3.

By way of example, and referring to FIGS. 1 through 3, certain embodiments of the present system comprise a headwear 10. The headwear is configured to define what will be worn on the user's head. In some embodiments, the headwear is a hat. In alternative embodiments, the headwear is a cap. In some embodiments, the headwear is a helmet. In alternative embodiments, the headwear is a hardhat. In some embodiments, the headwear is a visor. In some embodiments, the headwear comprises cloth. In alternative embodiments, the headwear comprises plastic. In some embodiments, the headwear comprises metal.

Headwear 10 further comprises a crown opening 20 attached to a brim 14. Brim 14 has an upper surface 24 and a lower surface 26. Lower surface 26 is attached to grip 12 with adhesive 18. Grip 12 extends from crown opening 20 towards distal edge 22. Grip 12 further comprises a tread having a first extended rounded surface 30 smoothly joined to first retracted rounded surface 32. First retracted rounded surface 32 is smoothly joined to second extended rounded surface 34. Second extended rounded surface 34 is smoothly joined to a second retracted rounded surface 36. Second retracted rounded surface 36 is smoothly joined to a first extended flat surface 38. First extended flat surface 38 is smoothly joined to a third retracted rounded surface 40. Third retracted rounded surface 40 is smoothly joined to a third extended rounded surface 42. Third extended rounded surface 42 is smoothly joined to a fourth retracted rounded surface 44. Fourth retracted rounded surface 44 is smoothly connected to a second extended flat surface 46. Second extended flat surface 46 is smoothly connected to a retracted flat surface 48. The retracted flat surface 48 is smoothly connected to a fourth extended rounded surface 50. Fourth extended rounded surface 50 is smoothly connected to a fifth retracted rounded surface 52. Fifth retracted rounded surface 52 is smoothly connected to a fifth extended rounded surface 54. Fifth extended rounded surface 54 is smoothly connected to a sixth retracted rounded surface 56. Sixth retracted rounded surface 56 is smoothly connected to the grip distal edge 60. In certain embodiments, the headwear comprises a brim 14. The brim is configured to extend from the headwear enclosing the user's head. In some embodiments, brim comprises cloth. In alternative embodiment, the brim comprises cardboard. In some embodiments, the brim comprises plastic. In alternative embodiments, the brim comprises metal.

In certain embodiments, the brim of the headwear comprises a grip 12. The grip is configured to have an upper grip surface and a lower grip surface. In some embodiments, the grip comprises a rubber like material. In alternative embodiments, the grip comprises rubber. In some embodiments, the grip comprises latex. In alternative embodiments, the grip comprises silicone. In some embodiments, the grip comprises silicone rubber. In alternative embodiments, the grip comprises butyl rubber. In some embodiments, the grip comprises aflas rubber. In alternative embodiments, the grip comprises chlorosulfonated polyethylene rubber. In some embodiments, the grip comprises epichlorohydrin rubber. In alternative embodiments, the grip comprises ethylene propylene rubber. In alternative embodiments, the grip comprises fluoroelastomer rubber. In some embodiments, the grip comprises hydrogenated nitrile rubber. In alternative embodiments, the grip comprises natural rubber. In some embodiments, the grip comprises nitrile rubber. In alternative embodiments, the grip comprises perfluoroelastomer rubber. In some embodiments, the grip comprises polycholoroprene rubber. In alternative embodiments, the grip comprises polyurethane rubber. In some embodiments, the grip comprises styrene butadiene rubber. In alternative embodiments, the grip comprises foam rubber. In some embodiments, the grip comprises plastic.

In certain embodiments, the upper grip surface of the grip is attached to the brim. In some embodiments, the upper grip surface of the grip is configured to be permanently attached to the brim. In alternative embodiments, the upper grip surface is configured removably attachable to the brim. In some embodiments, the grip is attached to the brim by a stitching 16. In alternative embodiments, the stitching comprises a cloth thread. In some embodiments, the stitching comprises a plastic thread. In alternative embodiments, the stitching comprises a nylon thread.

In certain embodiments, the upper grip surface of the grip is attached to the brim by an adhesive like substance 18. In some embodiments, the adhesive like substance is a glue. In alternative embodiments, the adhesive like substance is a rubber cement. In some embodiments, the adhesive like substance is an epoxy. In alternative embodiments, the adhesive like substance is a hook and loop fastener.

In certain embodiments, the lower grip surface comprises a tread. In alternative embodiments, the tread comprises alternating perforations. In some embodiments, the lower grip comprises a flat smooth surface.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A headwear grip system configured to substantially increase friction to a user's hand while gripping the headwear and increased friction to a surface the headwear may rest on, the headwear grip system comprising:

a headwear configured to rest on a wearer's head and further comprising a crown opening; and a brim, attached to the headwear and having a distal edge distant from the crown opening; wherein the brim has a top surface and a bottom surface; wherein the top surface faces away from the crown opening and the bottom surface faces toward the crown opening;

a grip surface configured to have an upper grip surface offset from the distal edge and a lower grip surface offset from the distal edge; wherein the upper grip surface and the lower grip surface extend from the crown opening toward the distal edge; wherein the upper grip surface attaches to the bottom surface of the brim; wherein the lower grip surface comprises a tread having a single, continuous grip surface extending continuously from the crown opening toward the distal edge of the brim, the single, continuous grip surface of the tread further comprising:

a first extended rounded surface, smoothly joined to a first retracted rounded surface;

a second extended rounded surface, smoothly joined to the first retracted rounded surface;

a second retracted rounded surface, smoothly joined to the second extended rounded surface;

a first extended flat surface, smoothly joined to the second retracted rounded surface;

a third retracted rounded surface, smoothly joined to the first extended flat surface;

a third extended rounded surface, smoothly joined to the third retracted rounded surface;

a fourth retracted rounded surface, smoothly joined to the third extended rounded surface;

a second extended flat surface, smoothly connected to the fourth retracted rounded surface;

a retracted flat surface, smoothly connected to the second extended flat surface;

a fourth extended rounded surface, smoothly connected to the retracted flat surface;

a fifth retracted rounded surface, smoothly connected to the fourth extended rounded surface;

a fifth extended rounded surface, smoothly connected to the fifth retracted rounded surface;

a sixth retracted rounded surface, smoothly connected to the fifth extended rounded surface; and a grip distal edge, smoothly connected to the sixth retracted rounded surface.

2. The headwear grip system of claim 1, further comprising a stitching wherein the stitching attaches the headwear to the upper grip surface.

3. The headwear grip system of claim 1, further comprising an adhesive wherein the adhesive attaches the headwear to the upper grip surface.

4. The headwear grip system of claim 1, further comprising a hook and loop fastener wherein the hook and loop fastener attaches the headwear to the upper grip surface.

* * * * *